United States Patent [19]

Wang et al.

[11] Patent Number: 4,514,286

[45] Date of Patent: Apr. 30, 1985

[54] FUEL SWEETENING WITH ORGANIC PEROXIDES

[75] Inventors: Sophia Wang, Houston; Glenn L. Roof, Sugar Land; Beth W. Porlier, Missouri City, all of Tex.

[73] Assignee: Nalco Chemical Company, Oak Brook, Ill.

[21] Appl. No.: 544,163

[22] Filed: Oct. 21, 1983

[51] Int. Cl.[3] ..... C10G 27/06

[52] U.S. Cl. ..... 208/196; 44/50

[58] Field of Search ..... 208/196, 203; 44/50

[56] References Cited

U.S. PATENT DOCUMENTS

| | | | |
|---|---|---|---|
| 2,593,761 | 4/1952 | Johnstone | 568/840 |
| 2,616,833 | 11/1952 | Chenicek et al. | 208/196 |
| 2,744,054 | 5/1956 | Pieters | 208/196 |
| 4,298,463 | 11/1981 | Frame | 208/203 |

FOREIGN PATENT DOCUMENTS

| | | | |
|---|---|---|---|
| 713740 | 7/1954 | United Kingdom | 208/196 |

*Primary Examiner*—Y. Harris-Smith

*Attorney, Agent, or Firm*—John G. Premo; Robert A. Miller; Donald G. Epple

[57] ABSTRACT

An improved process for reducing mercaptan (thiol) concentrations of sour petroleum distillates includes the treatment of these sour distillates with peroxy compounds, preferably tertiary butyl hydroxide and cumene hydroperoxide in the presence of oil-dispersible organic amine compounds such as quaternary ammonium hydroxide salts and alkalene polyamines. The preferred organic amine catalyst is Primene 81-R.

5 Claims, No Drawings

FUEL SWEETENING WITH ORGANIC PEROXIDES

INTRODUCTION

It is well known that the presence of organic sulfur compounds in gasoline lowers its lead susceptibility. That is, the introduction of tetraethyl lead causes a smaller improvement in the octane number of sour gasoline than would be obtained if the gasoline were free from organic sulfur compounds. Accordingly, from the standpoint of lead susceptibility and sulfur reduction, it is usually considered best practice to extract mercaptans from gasoline rather than to convert them into the less-reactive disulfides by oxidation treatment. However, except in those distillates which contain mercaptans of very low molecular weights, it becomes costly or uneconomical to extract all of the mercaptans. Accordingly it is advantageous to operate an extraction process so as to remove from about 50 to about 99% of the mercaptans present and then to oxidize the remaining mercaptans to disulfides.

One method of oxidizing the remaining mercaptans to disulfides is to utilize catalyzed organic peroxy-compounds and, in particular, cumene hydroperoxide, in a preferred embodiment, with a catalyst. This process is described in U.S. Pat. No. 2,593,761, which is incorporated herein by reference. The process of this patent may be used for reducing the mercaptan sulfur content of straight-run petroleum distillates including gasoline, kerosene, range oil, heater oil, and the like. The process is also applicable to cracked gasoline and naphtha. As the oxidation of the mercaptans results in the production of disulfides which are generally left in the gasoline or other petroleum distillate being treated, the sulfur content of this hydrocarbon material remains substantially unchanged after oxidation. As the lead susceptibility is improved by reducing the total sulfur content as well as by reducing the mercaptan content of the hydrocarbon distillate, it is desirable to extract the hydrocarbon material with caustic soda solution and, preferably, with caustic methanol solution to remove from about 50 to about 90% of the mercaptans. The remaining hydrocarbon material or raffinate containing from about 1 to about 50% of the original mercaptans is then treated by this process to oxidize mercaptans to disulfides.

The present invention may be considered as an improvement over the invention disclosed in U.S. Pat. No. 2,593,761 in that it employs an improved catalyst for increasing the effectiveness of cumene hydroperoxide in sweetening sour petroleum distillates by oxidizing mercaptans to disulfides.

In accordance with the invention, it, therefore, becomes an object to provide an improved method for sweetening sour petroleum distillates. A specific object of the invention is to provide an improved catalyst for improving the efficiency of peroxy compounds for treating sour petroleum distillate to oxidize the mercaptans contained therein to disulfides.

Other objects will appear hereafter.

THE INVENTION

A process for reducing the mercaptan concentration of a sour petroleum distillate by treating said petroleum distillate with a hydroperoxide compound in combination with a strong base catalyst chosen from the group consisting of oil-dispersible (or soluble) organic amine compounds and inorganic water-soluble or water-dispersible alkali and alkaline earth metal hydroxides and their corresponding oxides.

THE HYDROPEROXIDE COMPOUNDS

The hydroperoxide compounds of this invention may be any alkyl hydroperoxide. Examples of such compounds are tertiary butyl hydroperoxide and cumene hydroperoxide. Also expected to work would be peracetic acid and persuccinic acid. Peroxy compounds which do not work are the dialkyl peroxides, diaryl peroxides, and mixed alkylacyl (peroxyesters) peroxides. Materials which were tested and were found to be unsuccessful candidates include the following: di-t-butyl peroxide, dicumyl peroxide, dilauryl peroxide, dibenzoyl peroxide (Lucidol-98), t-butyl peroctoate and t-butyl perbenzoate. The organic hydroperoxy compounds constitute a preferred class of treating agents for use in this invention. Mixtures of hydroperoxy compounds may also be employed.

The preferred peroxy compounds of this invention include tertiary butyl hydroperoxide and cumene hydroperoxide and mixtures thereof. The most preferred peroxy compound of this invention is cumene hydroperoxide.

THE STRONG BASE CATALYSTS

The strong base catalysts are either organic or inorganic in nature.

The organic amine compounds used in the practice of the invention are all oil-dispersible or soluble organic amine compounds and, in a preferred embodiment, contain 1 or more primary, secondary, tertiary amino groups or quaternary ammonium groups. One preferred type of organic amine compound are those quaternary ammonium salts whose anionic counterion is in the hydroxide form. A most preferred material is tetramethylammonium hydroxide.

Another preferred group are the alkylene polyamines wherein the material contains 2 or more amine groups and at least 2 primary amino groups. Exemplary of such compounds are hexamethylene-triamine, ethylene diamine, and diethylenetriamine.

A preferred amine that has proven to be successful in catalyzing the mercaptan reduction activity of cumene hydroperoxide is the branched chain substituted primary amine sold under the tradename, Primene 81-R. Chemically, this material is composed of principally tertiary-alkyl primary amines having 11–14 carbons and has a molecular weight principally in the range of 171–213, a specific gravity at 25° C. of 0.813, a refractive index of 1.423 at 25° C. and a neutralization equivalent of about 191. The primary constituent of "Primene 81-R" is reported to be:

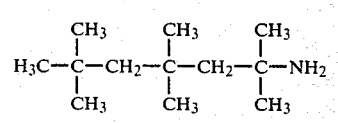

Other amines that may be used are 1,4-diazabicyclo[2,2,2]octane and tetramethylguanidine.

The inorganic base catalysts are chosen from the alkali metal hydroxides or oxides and from the alkaline earth metal hydroxides or their corresponding oxides. These materials are dissolved or suspended in water, then contacted with the sour fuel and hydroperoxide of choice. The preferred alkali metal hydroxide is sodium hydroxide used in a 10% aqueous solution. The preferred alkaline earth metal hydroxide is $Ca(OH)_2$, used in about a 2% aqueous slurry or used as a dispersed solid phase within the sour fuel.

DOSAGE

The amount of peroxy compounds required to effectively sweeten sour distillates may be varied depending upon the type of fuel, the amount of mercaptans present therein, and the temperature at which the sweetening reaction is conducted. In most cases, amounts ranging from as little as 100 up to as high as 1000 ppm of the peroxy compound may be used. The amount of amine used may vary between as little as 50 up to several thousand ppm. As a general rule, the higher the reaction temperature, the smaller the amount of peroxy compound and amine will be required to give good results. Smaller amounts of both the amine and peroxy compound may be used if the time of sweetening at a given temperature is extended. Generally, good sweetening can be achieved by contacting the sour distillate with the compositions used in the practice of the invention for a period of time ranging between 15 minutes–55 hours. From 01.5 to 5 hours is adequate in most cases.

As a general rule, the peroxy compound of choice is cumene hydroperoxide and the amount of cumene hydroperoxide in relation to amine or inorganic base catalyst (either alkali metal or alkaline earth metal hydroxides) is usually about 4:1 to 1:4; preferably, from 2:1 to 1:2; and most preferably, about 1:1, all ratios given on a weight basis.

To illustrate the advantages of the invention, the following are presented by way of example:

EXAMPLE 1

A solvent blend of 80% by weight iso-octane and 20% by weight toluene was dosed with about 100 ppm of a known standard octane thiol. This blank material, which analyzed as containing 105 ppm of octane thiol after 2 days, was added to various quantities of cumene hydroperoxide. The results are presented in Table I.

TABLE I[1]

Cumene Hydroperoxide Oxidation of Octane Thiol in the Absence of a Catalyst[1,2]

| moles CHP per mole $C_8H_{17}SH$ | ppm of $C_8H_{17}SH$ after 2 days |
|---|---|
| Blank | 105 |
| 0.5[3] | 110 |
| 1.0[3] | 100 |
| 4.0[3] | 96.3 |
| 8.0[3] | 96.3 |

[1]It should be noted that the samples were prepared in the presence of air and were stirred on a stir plate for the indicated time period.
[2]A solvent blend of 80% iso-octane/20% toluene was dosed with about 100 ppm of octane thiol.
[3]The samples were allowed to sweeten for 2 days (48 hours) prior to titration.

The data in Table I shows the values of octane thiol present after exposure to various quantities of cumene hydroperoxide and illustrates that the reaction of cumene hydroperoxide with octane thiol in the absence of catalyst is extremely slow and, in fact, may not react at all under these conditions.

EXAMPLE 2

A prescribed amount of a sour fuel obtained from a Southwestern refinery was treated with 4000 ppm of cumene hydroperoxide in the presence of various types of amine compounds at a 1000 ppm level. The results are in Table II.

TABLE II

Catalysts for the Cumene Hydroperoxide Oxidation of Thiols

| Cumene Hydroperoxide (40% sol. in hydrocarbon) | Amine conc. (ppm) | ppm RSH O time | As $CH_3SH$ 1 hour |
|---|---|---|---|
| Blank | — | 236 | — |
| 4000 ppm | diazabicyclo[2,2,2]octane (1000) | | 120 |
| 4000 ppm | tetrabutylammonium hydroxide (1000) | 1.75 | |
| 4000 ppm | tetramethylguanidine (1000) | 113 | |
| 4000 ppm | hexamethylenetriamine (1000) | 15.7 | |
| 4000 ppm | ethylene diamine (1000) | 109 | |
| 4000 ppm | diethylenetriamine (1000) | 89 | |

Since the titroprocessor cannot differentiate thiols, it arbitrarily assigns an equivalent weight of 32; consequently, except for $CH_3SH$ (eq. wt.=32), the thiols present will all have higher eq. wts. and actual ppm's will be higher than those reported.

All of the samples were prepared in the presence of air and were stirred on a stirring plate for the indicated time. After 1 hour, the amount of free thiol was determined by potentiometric analysis.

As can be seen from Table II results, all of the amine and tetraalkylammonium hydroxide samples tested effectively catalyzed the removal of thiols from this commercial sour fuel. Under the worst conditions, the thiols were removed to approximately ½ the initial value in only 1 hour. Since the determination of free thiol was made by potentiometric techniques, each type of thiol could not be differentiated. An arbitrary equivalent weight of 32 was assigned for this titration of the thiol present. Consequently, except for methane thiol, whose equivalent weight is 32, all other thiols present will have higher equivalent weights and the actual ppm thiols will be higher than those reported in Table II. However, since this also refers to the blank determination of "RSH", the relative removal is still demonstrable in Table II. In each case, the amine is added at 1000 ppm of 100% amine except for tetrabutylammonium hydroxide, which was added as a 25% methanolic solution, so that for this compound only, the actual concentration of active ingredient is 250 ppm.

The tetrabutylammonium hydroxide is seen in Table II to be the best catalyst. However, because of cost and availability, additional work was done using tetramethylammonium hydroxide, a material which is readily available commercially.

EXAMPLE 3

Example 3 is a representation of data collected where the effect of various concentrations of tetramethylammonium hydroxide on the sweetening process of a sour fuel derived from a Southwest United States refinery was measured. Each sample was dosed with 4000 ppm of a 40% solution of cumene hydroperoxide in the presence of varying quantities of a 20% solution of tetramethylammonium hydroxide in methanol. Again, the samples were prepared in the presence of air and were stirred on a stir plate for the indicated time periods.

TABLE III

The Effect of Changing the Concentration of Tetramethylammonium Hydroxide

| Cumene Hydroperoxide (40% sol. in hydrocarbon) | Tetramethylammonium hydroxide conc (ppm)[1] | ppm RSH 0 hrs. | ½ hr. | 24 hrs |
|---|---|---|---|---|
| Blank | — | 236.7 | — | — |
| 4000 ppm | — | — | 235 | — |
| 4000 ppm | 1000 | — | 1.6 | — |
| 4000 ppm | 500 | — | 3.1 | — |
| 4000 ppm | 400 | — | 2.6 | — |
| 4000 ppm | 300 | — | 12 | — |
| 4000 ppm | 200 | — | 55 | 28.4 |
| 4000 ppm | 100 | — | 139 | 98.0 |
| 4000 ppm | 60 | — | 159 | — |

[1]Tetramethylammonium hydroxide dosage concentrations are expressed as 100% material even though it was dosed from a 20% solution in methanol.

EXAMPLE 4

The results of reducing concentrations of cumene hydroperoxide as well as varying the concentration of tetramethylammonium hydroxide are illustrated in Table IV. The same commercial sour fuel was used as previously indicated. Again, the samples were prepared in the presence of air and were stirred on a stir plate for the indicated time.

TABLE IV

The Effect of Varying Both the Concentration of Cumene Hydroperoxide & Tetramethylammonium Hydroxide

| Cumene Hydroperoxide added as 40% sol. | Tetramethylammonium Hydroxide added as 20% solu. in MeOH[1] | ppm RSH ½ hour |
|---|---|---|
| Blank | — | 237 |
| 3000 ppm | 60 ppm | 142 |
| 2000 ppm | 60 ppm | 114 |
| 1000 ppm | 60 ppm | 86 |
| 1000 ppm | 100 ppm | 42 |
| 1000 ppm | 150 ppm | 34.5 |
| 1000 ppm | 200 ppm | 9.4 |
| 2000 ppm | 200 ppm | 8.5 |
| 750 ppm | 200 ppm | 17 |

[1]Tetramethylammonium hydroxide dosage concentrations are expressed as 100% material even though it was dosed from a 20% solution in methanol.

EXAMPLE 5

Additional work was done to demonstrate other potential amine catalysts for peroxy compound oxidation of thiols. The data in Table V indicates various types of potential amine catalysts for use with cumene hydroperoxide to sweeten fuels containing thiols.

TABLE V

Potential Amine Catalysts for Cumene Hydroperoxide Oxidation of Thiols

| Cumene Hydroperoxide (40% sol. in hydrocarbon solvent) | Amine conc (ppm) | ppm RSH 0 hrs. | 20–22 hrs. |
|---|---|---|---|
| Blank | — | 350 | — |
| 750 | hexamethylenediamine (1000) | — | 4.1 |
| 500 | hexamethylenediamine (1000) | — | 138 |
| 750 | isopropylamine (1000) | — | 34.6 |
| 500 | isopropylamine (1000) | — | 181 |

TABLE V-continued

Potential Amine Catalysts for Cumene Hydroperoxide Oxidation of Thiols

| Cumene Hydroperoxide (40% sol. in hydrocarbon solvent) | Amine conc (ppm) | ppm RSH 0 hrs. | 20–22 hrs. |
|---|---|---|---|
| 750 | Primene 81R (1000) | — | 3.1 |
| 500 | Primene 81R (1000) | — | 125 |
| 750 | diethanolamine (1000) | — | 229 |
| 750 | 1,4 diazabicyclo[2,2,2] octane (750) | — | 12 |

As can be seen from the results of Table V, Primene 81-R is selected as the catalyst of choice because it is an effective oil-soluble organic amine compound catalyst for the oxidation of thiols to disulfides by peroxy compounds, particularly cumene hydroperoxide. As a starting raw material, it is less expensive than the other amine compounds tested and has the benefit of being water immiscible, or oil-soluble and dispersible.

Additional tests were run with a combination product of cumene hydroperoxide and Primene 81-R. Particularly of note were the results of corrosion tests on fuel that had been sweetened with various combination products of cumene hydroperoxide and Primene 81-R. The results of these tests indicated simply that when cumene hydroperoxide is combined with Primene 81-R in appropriate ratios from about 4:1 to 1:4, and preferably about 2:1 to 1:2, and most preferably about 1:1, on a weight basis, the corrosion potential for this combination is severely limited. This is to be compared with cumene hydroperoxide alone which gives severe corrosion results when tested at concentration levels which would be effective as sweetener additives. The combination of cumene hydroperoxide with Primene 81-R at the indicated ratios above prevents severe corrosion and simultaneously catalyzes thiol removal from sour hydrocarbon fuels.

To demonstrate the use of inorganic base catalysts, Table VI is presented below;

TABLE VI

This Table Illustrates the Effect of Varying Both the Concentration of Oxidizer and Catalyst using a Real World Sour Fuel[1]

| Sample | Cumene Hydroperoxide (80%) | Aqueous NaOH (10%) | Agitated[2] | ppm RSH/RxN Time (hrs) Early | Late |
|---|---|---|---|---|---|
| Blank | — | — | — | 46/0 | 46/40.0 |
| 1 | 390 ppm | — | Yes | 45/18.0 | — |
| 2 | — | 600 ppm | Yes | 39/18.5 | 33/44 |
| 3 | 390 ppm | 600 ppm | Yes | 25/16.0 | 13/43.0 |
| 4 | 1500 ppm | 1200 ppm | No | 24/16.5 | — |
| 5 | 1500 ppm | 1200 ppm | Yes | 9/16.8 | 4/40.0 |
| 6 | 1500 ppm | 900 ppm | No | 19/17.0 | 8/41.0 |
| 7 | 1500 ppm | 900 ppm | Yes | 9/17.5 | — |
| 8 | 1200 ppm | 900 ppm | No | 26/17.8 | 9/41.0 |
| 9 | 1200 ppm | 900 ppm | Yes | 9/18.0 | 5/40.0 |
| 10 | 1200 ppm | 600 ppm | No | 32/18.2 | — |
| 11 | 1200 ppm | 600 ppm | Yes | 10/18.5 | — |
| 12 | 900 ppm | 900 ppm | No | 26/19.0 | 15/41.0 |
| 13 | 900 ppm | 900 ppm | Yes | 12/20.0 | 4/40.0 |

[1]All samples were run in an argon atmosphere.
[2]Agitated samples were shaken on a mechanical shaker for the duration; non-agitated samples were dosed in a screw cap bottle, shaken 10 minutes and then allowed to stand for the duration.

One can clearly see the diminution of thiol level as a function of reaction time and agitation; additionally, neither the peroxide without catalyst nor the catalyst without peroxide is an effective sweetener.

We claim:

1. A process for reducing the mercaptan concentration of a sour petroleum distillate which comprises treating said petroleum distillate with a hydroperoxide compound in combination with a strong base catalyst chosen from the group consisting of quaternary ammonium hydroxide salts from the group consisting of tetraethylammonium hydroxide, tetrapropylammonium hydroxide, tetremethylammonium hydroxide, tetrabutylammonium hydroxide, and mixtures thereof.

2. The process of claim 1 wherein the hydroperoxide compound is chosen from the group consisting of tertiary butyl hydroperoxide, cumene hydroperoxide, and mixtures thereof.

3. In an improved process for reducing mercaptan concentration of a sour petroleum distillate with a hydroperoxide compound, the improvement which comprises treating said sour petroleum distillate with said hydroperoxide compound in combination with a strong base catalyst chosen from the group consisting of oil-dispersible or soluble amine compounds which are chosen from the group consisting of quaternary ammonium hydroxide salts, alkylene polyamines, tertiary-alkyl primary amines having 11–14 carbons and a molecular weight in the range of 171–213, and 1,4diazabicyclo[2,2,2]octane.

4. The process of claim 3 wherein the quaternary ammonium hydroxide salts are chosen from the group consisting of tetrabutylammonium hydroxide, tetramethylammonium hydroxide, tetramethylquanidine, tetraethylammonium hydroxide, tetrapropylammonium hydroxide, and mixtures thereof.

5. The method of claim 3 wherein the alkylene polyamine is a hexamethylene-triamine.

* * * * *